United States Patent [19]

Relis et al.

[11] Patent Number: 4,666,389

[45] Date of Patent: May 19, 1987

[54] APPARATUS FOR FORMING COMPACTS FROM SOLID PARTICLES

[75] Inventors: Matityahu Relis, Kiryat Tivon, Israel; William B. Ledbetter, College Station, Tex.

[73] Assignee: The Texas A&M University System, College Station, Tex.

[21] Appl. No.: 695,004

[22] Filed: Jan. 25, 1985

[51] Int. Cl.[4] ..... B22F 3/00

[52] U.S. Cl. ..... 425/78; 425/412

[58] Field of Search ..... 249/160, 163, 164, 161; 425/78, 412, 415, 421, 432, 450.1

[56] References Cited

U.S. PATENT DOCUMENTS

| | | | |
|---|---|---|---|
| 101,896 | 4/1870 | McAlpin | 249/164 |
| 329,284 | 10/1885 | Dalzell | 76/108 |
| 521,929 | 6/1894 | Cameron | 249/164 X |
| 707,279 | 8/1902 | Sweet | 249/164 |
| 986,957 | 3/1911 | Wallin | 249/164 X |
| 1,119,711 | 12/1914 | McGee | 249/164 X |
| 1,286,089 | 11/1918 | Pfanstiehl | 425/78 X |
| 1,326,614 | 12/1919 | Pfanstiehl | 425/78 X |
| 1,766,098 | 6/1930 | Booth | 207/17 |
| 1,855,855 | 4/1932 | Gillis et al. | 425/78 |
| 2,253,003 | 8/1941 | Whipple | 425/78 X |
| 2,278,293 | 3/1942 | Watson | 78/62 |
| 2,282,155 | 5/1942 | Bandur | 425/78 |
| 2,389,876 | 11/1945 | Sequin | 207/17 |
| 2,482,342 | 9/1949 | Hubbert et al. | 425/78 |
| 2,526,489 | 10/1950 | Liddicoat | 76/108 |
| 2,787,828 | 4/1957 | Cousino | 29/553 |
| 3,156,011 | 11/1964 | Olson | 425/78 X |
| 3,163,908 | 1/1965 | Lawmaster | 249/164 |
| 3,187,549 | 6/1965 | Guy | 72/478 |
| 3,189,942 | 6/1965 | Rapprich et al. | 425/78 |
| 3,230,286 | 1/1966 | Bobrowsky | 425/78 X |

OTHER PUBLICATIONS

Article by M. Relis and I. Soroka entitled "Prediction of Standard Compressive Strength of Cement by Means of Accelerated Testing", from Materiaux et Constructions (France), vol. 7, No. 38, pp. 103–109, 1974.

Article by M. Relis and I. Soroka, "Effect of Added Gypsum on Compressive Strength of Portland Cement Clinker", Ceramic Bulletin, vol. 62, No. 6, pp. 695–703, 1983.

Article by M. Relis and I. Soroka, "Variation in Density of Portland Cement Hydration Products", Cement and Concrete Research, vol. 7, pp. 673–680, 1977.

Article by M. Relis and I. Soroka, "Limiting Values for Density, Expansion an Intrinsic Shrinkage in Hydrated Portland Cement", Cement and Concrete Research, vol. 10, pp. 499–508, 1980.

Article by M. Relis and I. Soroka, "Compressive Strength of Low-Porosity Hydrated Portland Cement", Journal of the American Ceramic Society, vol. 63, No. 11–12, 11–12/1980, pp. 690–694.

Thesis by M. Relis for the Degree of Master of Science in Civil Engineering entitled "Early Evaluation of the Standard and Non-Standard Strength of Cement by Accelerated Tests", dated Apr. 1972, (Abstract only).

Abstract portion of a thesis submitted by M. Relis for the degree of Doctor of Science entitled "Structure of Low Porosity Cement Stone and its Mechanical and Physical Properties", dated Mar. 1981.

*Primary Examiner*—J. Howard Flint, Jr.

*Attorney, Agent, or Firm*—Arnold, White & Durkee

[57] ABSTRACT

There is disclosed a method and apparatus for forming compacts from finely divided solid particles or a mixture of fine and coarse particles in a dry, semi-dry or plastic state by the application of ultra-high pressures in the range of 100,000 psi and greater while preventing delamination upon extraction of the finished product. A die is provided that has a plurality of die segments resting on a base to form a die chamber. A retainer is secured to the base, and surrounds and engages the die segments to prevent movement of the die segments during the forming process. Means are provided for substantially instantaneous disengagement of the retainer from all of the die segments.

11 Claims, 6 Drawing Figures

56
52
54
46
48
44
40
10
38
36
50
18
24
22
26
34
24
32
12
12
25
26
20
14
42

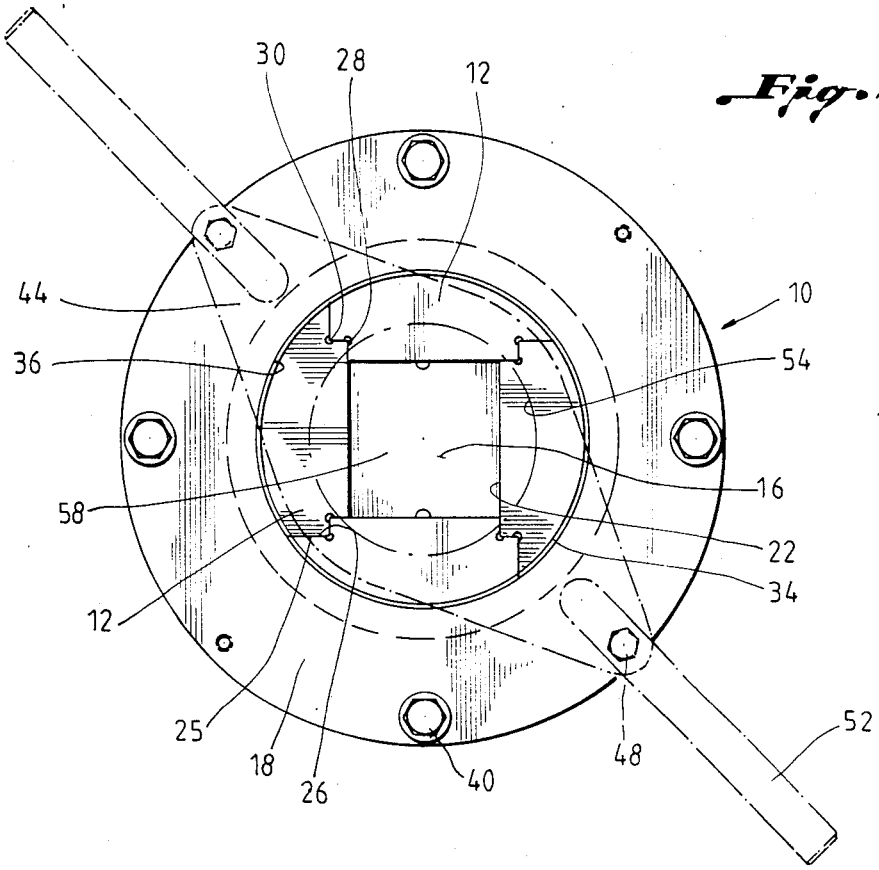
Fig. 2
Fig. 3
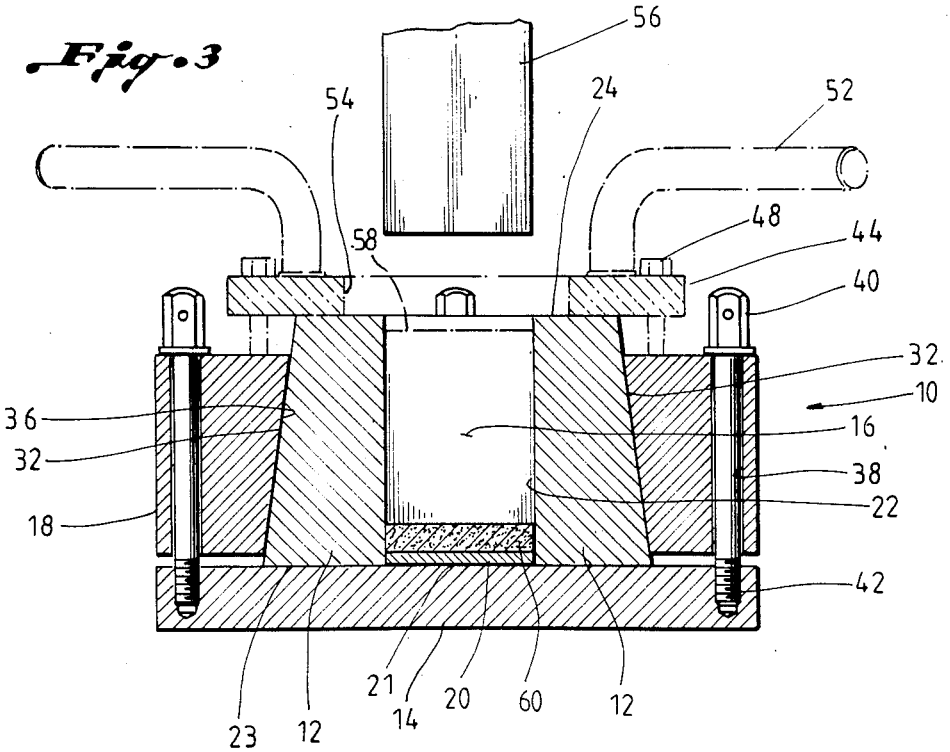

APPARATUS FOR FORMING COMPACTS FROM SOLID PARTICLES

The U.S. Government has a paid-up license in the invention of claims 8–10 and the right in limited circumstances to require the patent owner to license others on reasonable terms as provided for by the terms of Contract No. F08635-84-K-0053 awarded by the Department of the Air Force, Armament Division.

BACKGROUND OF THE INVENTION

This invention relates to an apparatus for forming compacts from finely divided solid particles or a mixture of fine and coarse solid particles in a dry, semi-dry or plastic state. More specifically, this invention concerns a die for manufacturing relatively large compacts by applying ultra-high pressure to a mixture of such solid particles.

It is known in the art that if a sufficiently high pressure is applied to the mixtures of particles mentioned above, the particles will be compressed into a solid element. This solid element, referred to as a compact, is a highly densified, low-porosity agglomeration of particles. The ultra-high pressures required to form compacts usually exceed 100,000 psi, and may perhaps exceed 1,000,000 psi applied to the particles. The amount of pressure required will depend on the type of solid particles used, the sizes, gradations and strength of the particles, the amount of vibration applied to the particles, and the degree of density desired.

During formation of a compact, the initial volume taken up by the solids decreases and the density increases. That is, the discrete particles are brought closer together, some of the smaller particles fill in the spaces between the larger particles, some particles break into smaller particles, and some of the particles perhaps change shape, so that the spaces between the particles are substantially reduced. In this denser state, the individual particles tend to bind together by different phenomena, some of which are as yet unidentified. Some of these phenomena relate to friction at points of contact between the particles and some probably relate to bonds at the atomic level.

After compaction, some elastic energy remains in the particles, making the compact tend to expand outwardly after pressure is released. This residual elastic energy creates problems in removing the compact from the die in which it is formed. Unless the lateral forces retaining the compact are released simultaneously, the compact will tend to delaminate during removal from the die.

Specifically, existing dies are rigidly constructed. To remove the compact from such a die, one wall of the die is removed and the compact is extruded or ejected from the die. This results in a nonuniform release of pressure from the compact, causing delamination during extrusion or ejection. This is a problem in the formation of compacts by high pressure of any practical size suitable for use in industrial and commercial applications, i.e., for compacts larger than 1 cm. across.

Prior to the present invention, no die was capable of withstanding the ultra-high pressures necessary for forming compacts and at the same time providing a mechanism for removing the compact from the die without delamination. Using the present invention, compacts can be formed into any desired shape for industrial or commercial use. They can be formed into a wide variety of sizes and shapes for use in products such as roofing tiles, floor tiles, blocks, bricks, railroad ties, manhole covers, and architectural shapes. The present invention can also be used in powder metallurgy and ceramic products.

Compacts have significant advantages over traditional man-made products. They are considerably stronger, more durable, more volume stable, more dimensionally accurate, and less porous than conventional products. They can be formed of traditional construction materials, such as portland cement, blended cement, concrete, gypsum, fly ash, lime, natural cement, blast furnace cement, etc. For special applications, such as space shuttle tiles, materials such as cermets, graphite compacts, silica compacts, and metal powders could be used in the present invention.

Because of their increased strength, compacts can be made thinner and/or lighter in weight than conventional products, thereby reducing structural dead load. Additionally, the increased strength and dimensional accuracy of compacts result in a much lower rejection rate during manufacture, transportation and installation.

SUMMARY OF THE INVENTION

According to the present invention, there is provided an apparatus capable of producing a compact which alleviates the problem of delamination of the compact during removal from the die.

In one embodiment of the apparatus aspect of the invention, a die is provided for forming compacts from solid particles by applying high pressure through a ram to the particles. The die has a laterally disposed base, and a plurality of die segments resting on the base to form an upwardly open die chamber to receive a ram under pressure. Each die segment has an interior wall which defines a portion of the die chamber. An exterior camming surface on each die segment is inclined radially inwardly from the base upwardly toward the top of the die segment. Each die segment also has first and second lateral faces. Each first lateral face of one die segment mates with a second lateral face of an adjacent die segment. A retainer is adapted to be lowered around the die segments and to be secured to the base to peripherally enclose the mated die segments. The retainer has internal camming surface portions which engage the exterior camming surfaces of the die segments to prevent substantial horizontal and vertical movement of the die segments when pressure is applied to the solid particles placed in the die chamber. Means are also provided for moving the retainer vertically away from the base. This substantially simultaneously disengages the internal camming surface portions of the retainer from the exterior camming surfaces of the die segments.

In another embodiment of the die, the retainer is secured to the base by a plurality of bolts each extending through a separate aperture in the retainer and threading into a corresponding threaded aperture in the base. The releasing means includes a plate bearing against top surfaces of the die segments and at least one bolt extending from an upper side of the retainer through an aperture in the plate. The bolt has a nut threaded onto the end of the bolt protruding from the upper side of the plate.

In a further embodiment of the die according to the present invention, the exterior camming surfaces of the die segments form a continuous, frustoconical surface. The retainer is ring-shaped and the internal camming surface portions of the retainer comprise a continuous, frustoconical surface adapted to mate with the corresponding exterior surfaces of the die segments.

In still another embodiment of the die, the exterior camming surfaces of the die segments form a frustopyramidal surface. The retainer is rectangular-shaped with a plurality of discrete, internal camming surfaces projecting inwardly from the retainer at spaced points around the inside perimeter of the retainer.

In a still further embodiment of the die, the first and second lateral faces of the die segments each comprises a longitudinally stepped surface. An interior corner of the first and second lateral faces is notched to relieve stress concentrations.

A method is provided for forming a compact from solid particles. A cylindrical die chamber is provided which is defined by a base and a plurality of die segment vertical walls. Solid particles are placed in the chamber, and a downward pressure is applied to the particles sufficient to compress them into a compact of desired density. Any substantial movement of the base and the vertical walls is prevented while the pressure is being applied. The pressure is then removed, and the vertical walls are substantially simultaneously retracted from the compact to uniformly release lateral internal stresses developed in the compact during compression so that the compact does not delaminate.

In another embodiment of the method, substantial movement of the vertical walls is prevented by providing a retainer which surrounds and engages the die segments. The vertical walls are substantially simultaneously retracted by suddenly disengaging the retainer from the die segments.

It is an advantage of the present invention that a die is provided which can withstand the high pressures necessary for forming relatively large compacts from finely divided solid particles, or a mixture of fine and coarse solid particles in a dry, semi-dry or plastic state.

Another advantage of the invention is that an apparatus is provided which substantially eliminates the problem of delamination when removing the compact from the die.

A further advantage of the present invention is that an apparatus is provided for producing compacts for commercial and industrial use.

Yet another advantage of the apparatus the present invention is that compacts for commercial and industrial use can be manufactured using relatively inexpensive and readily available materials.

BRIEF DESCRIPTION OF THE DRAWINGS

FIG. 2 is a top view of the die of FIG. 1 as assembled.

FIG. 3 is a sectional view of the die of FIG. 1 as assembled after compaction of the solid particles and showing the pre-compacted solid particles in phantom.

DETAILED DESCRIPTION OF THE PREFERRED EMBODIMENTS

Figure 1:
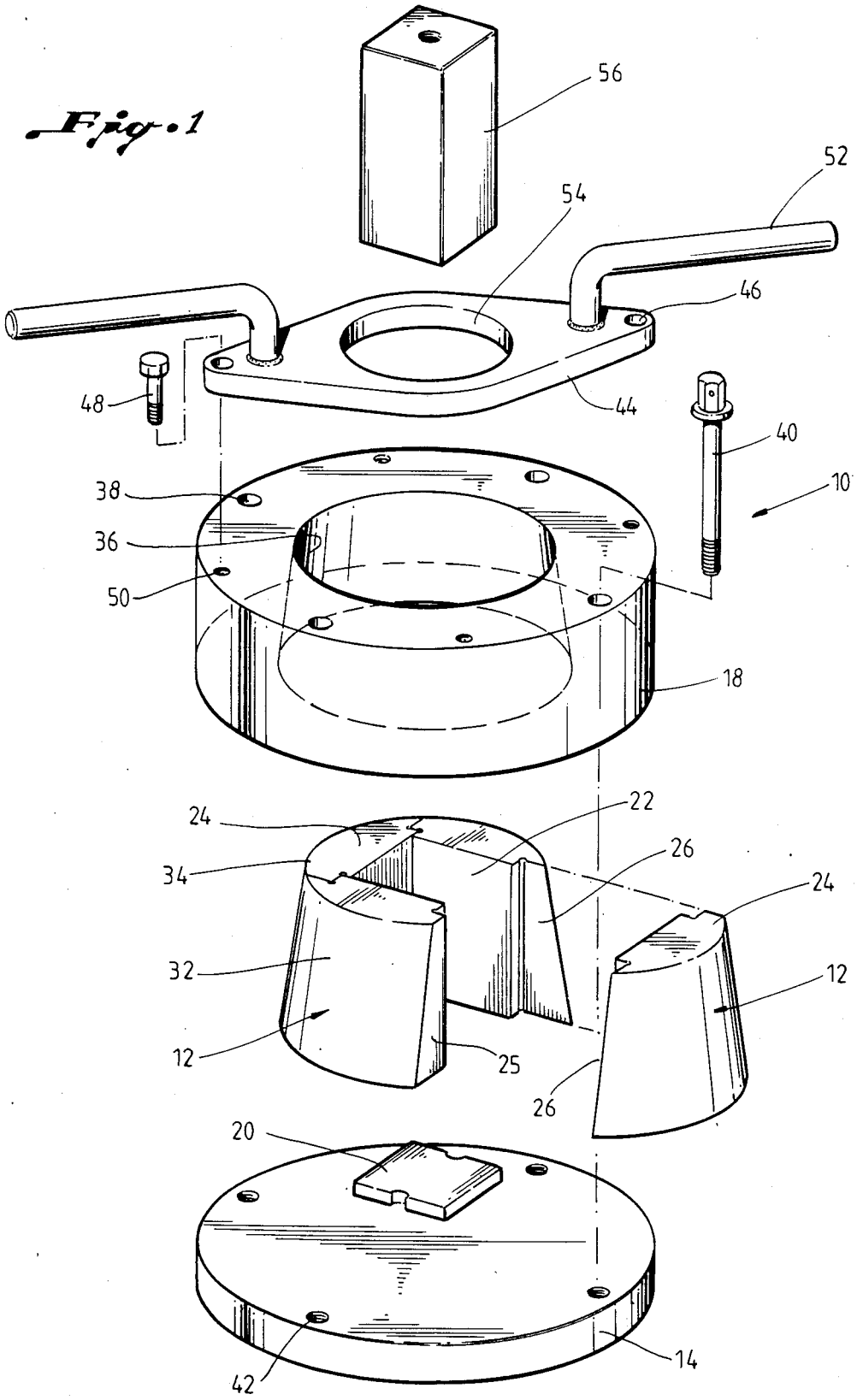
FIG. 1 is an exploded perspective view of one embodiment of a die built in accordance with the present invention.

In the description that follows, similar reference numerals refer to similar elements in all figures of the drawings.

Referring first to FIGS. 1 and 2, there is shown a die 10 built in accordance with this invention. The die has a plurality of die segments 12 resting on a base 14 to form a die chamber 16. A retaining ring 18 is secured to base 14, surrounding and engaging die segments 12 to prevent movement of the die segments during the forming process. Base 14 has an anvil 20 centrally positioned thereon.

Each die segment 12 has an interior wall 22, a bottom surface 23, and a top surface 24. Each die segment also has a first stepped lateral face 25 and a second stepped lateral face 26.

When in the assembled position, interior walls 22 of the die segments define the vertical walls of die chamber 16, and the upper surface of anvil 20 defines the bottom of the die chamber. Bottom surfaces 23 of die segments 12 rest against base 14, and the lower portions of interior walls 22 are positioned against anvil 20. In this way, anvil 20 aids in positioning die segments 12 relative to each other and relative to base 14.

Also in the assembled position, a first stepped lateral face 25 of one die segment 12 mates with a second stepped lateral face 26 of an adjacent die segment. Lateral faces 25, 26 are preferably stepped as shown for two reasons. First, by using a stepped surface, rather than a straight surface, stress concentrations in the die segments are reduced. Second, the zigzagging joint between die segments 12 created by lateral faces 25, 26 better prevents solid particles from getting into the joints between the die segements during the compression process.

Preferably, each lateral face 25, 26 has a notch or fillet 28, 30, respectively on their interior corners. Again, the purpose of these notches is to prevent stress concentrations. Notches 28, 30 can be arcuate as shown or any other suitable configuration capable of preventing stress concentrations.

Each die segment 12 has an exterior camming surface 32. Camming surfaces 32 are inclined inwardly from the base to the top of the die segments. When die segments 12 are in the assembled position on base 14, exterior camming surfaces 32 together form a continuous, frustoconical surface 34.

Retaining ring 18 has an internal frustoconical surface 36 which engages frustoconical surface 34 formed by die segments 12. Frustoconical surfaces 34, 36 are preferably inclined at a slope of 8 to 1, vertical to horizontal.

Retaining ring 18 has four apertures 38 spaced around its perimeter to accept corresponding clamping bolts 40. The clamping bolts are in turn threaded into corresponding apertures 42 in base 14 to secure retaining ring 18 to the base.

Positioned against top surfaces 24 of die segments 12 is a release plate 44. A pair of apertures 46 in release plate 44 accept a corresponding pair of quick release bolts 48 threaded into apertures 50 in retaining ring 18. A pair of handles 52 permits easy handling of the release plate and retaining ring 18. A central hole 54 in release plate 44 provides a passage for a ram 56 of a press (not shown) to pass into die chamber 16.

Formation of a compact by use of die 10 is as follows. Die segments 12 are positioned against anvil 20 as shown in FIGS. 2 and 3. Retaining ring 18 and release plate 44 are then lowered onto die segments 12. Clamping bolts 40 are tightened down into threaded apertures 42 in base 14. This secures retaining ring 18 to base 14, and brings frustoconical surfaces 34, 36 into tight, mating engagement. In this position, because of the camming action of the frustoconical surfaces, die segments 12 are held in tight contact with base 14 and also with each other.

The dry, semi-dry, or wet solid particles of material or a mixture thereof to be compacted 58 are then inserted into die chamber 16. The amount of material used depends on the desired thickness of the compact. Also, the amount of material will vary depending upon the density of the compact. The die may then be vibrated to settle the particles as much as possible before compaction begins. Preferably, solid particles 58 should not extend completely to the top of die chamber 16 for compaction to begin, or a system to contain any excess material should be added to the top of the chamber. Ram 56 should extend partly into die chamber 16 or below the containing system before contacting solid particles 58.

Ram 56 is then brought down into contact with solid particles 58, either statically or dynamically. Of course, as pressure is applied by ram 56, lateral pressures, will be transmitted through solid particles 58 and into die segments 12. However, retaining ring 18 prevents die segments 12 from moving under the applied pressures. After the solid particles are compacted to a desired density, ram 56 is withdrawn, leaving a compact 60 in die chamber 16.

Clamping bolts 40 are then loosened. This, however, will not disengage retaining ring 18 from die segments 12. Because of the high pressures created during the forming process, frustoconical surfaces 34, 36 become wedged together. In order to provide a uniform release of the lateral pressures confining the compact 60, it is desirable to simultaneously retract die segments 12 from the compact.

This is accomplished by instantaneously disengaging retaining ring 18 from die segments 12. After clamping bolts 40 have all been loosened, one of the quick release bolts 48 is tightened down. With release plate 44 bearing against the top surfaces 24 of die segments 12, this tightening down of a bolt 48 draws retaining ring 18 upwardly. Because of the camming action of frustoconical surfaces 34, 36, at a certain point in tightening bolt 48, retaining ring 18 will suddenly pop free of die segments 12. This sudden disengagement will occur simultaneously around the circumference of frustoconical surfaces 34, 36. As retaining ring 18 moves upwardly, the camming action of frustoconical surfaces 34, 36 permits die segments 12 to move simultaneously outwardly away from compact 60.

To withstand the high stresses produced by the ultra-high pressure compaction, die segments 12, base 14, and retaining ring 18 are preferably made of case hardened high-strength steel with machined surfaces for a tight fit between the various parts. Die 10 can be used to form compacts from a variety of materials, including fly ash, clay, powdered plastics, portland cement, blended cement, concrete, gypsum, lime, natural cement, blast furnace cement, metal particles, etc. Further, these materials can be compacted with or without a liquid additive. For example, concrete can be compacted dry or with water added. Also, it is possible to manufacture compacts of composite materials. For example, shingles or tiles can be made of a composite material including concrete with glass, steel, polyethylene or other fibers added for stength, toughness, and/or durability. Practically any material in particle, paste, or powder form can be used.

The die of the present invention also permits application of heat before, during, or after compaction. It may be helpful to add heat when forming a particulate composite compact, i.e., a compact made of more than one type of material.

Figure 4:
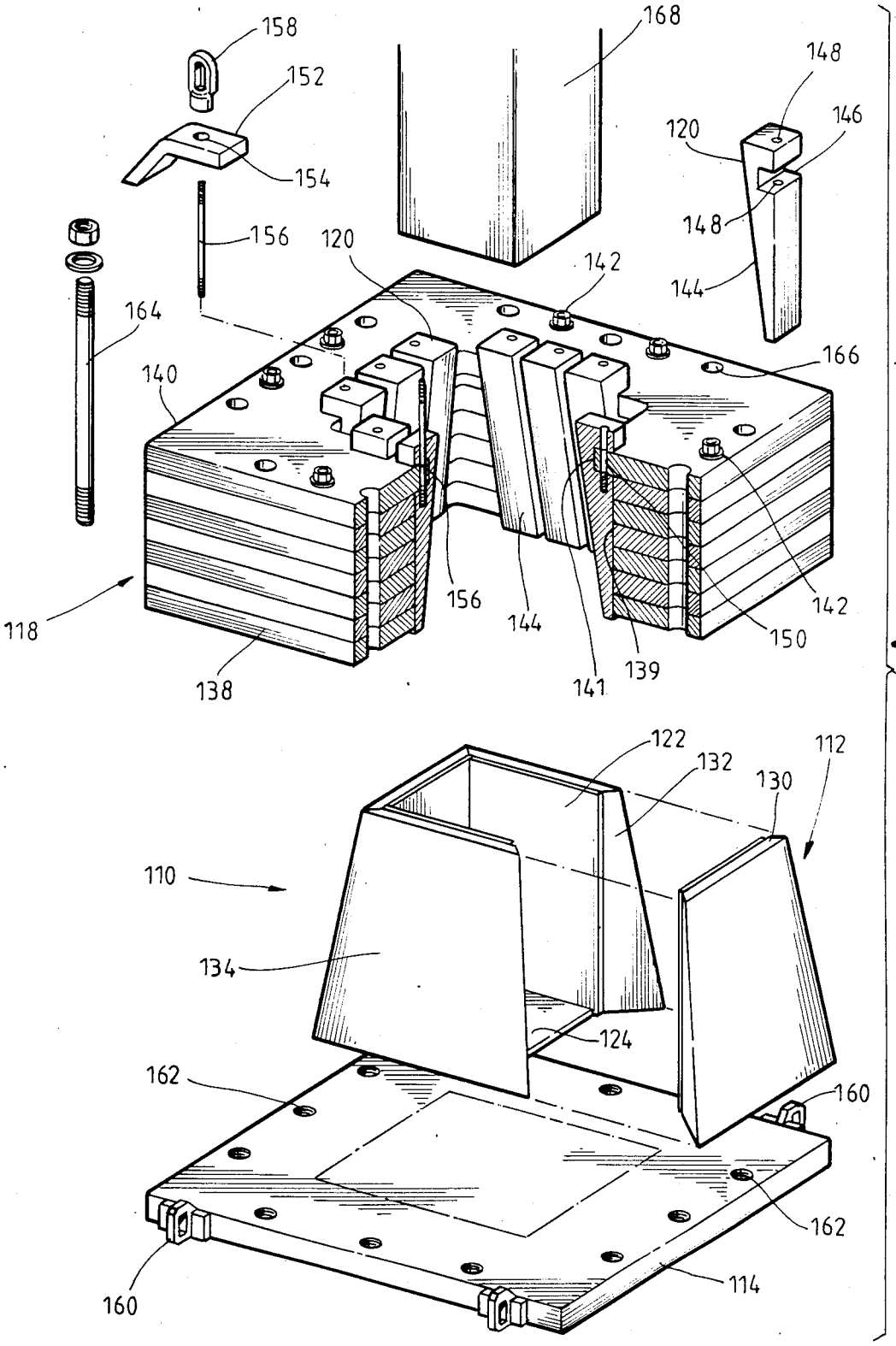
FIG. 4 is an exploded perspective view of an alternative embodiment of a die constructed in accordance with the present invention.
Figure 5:
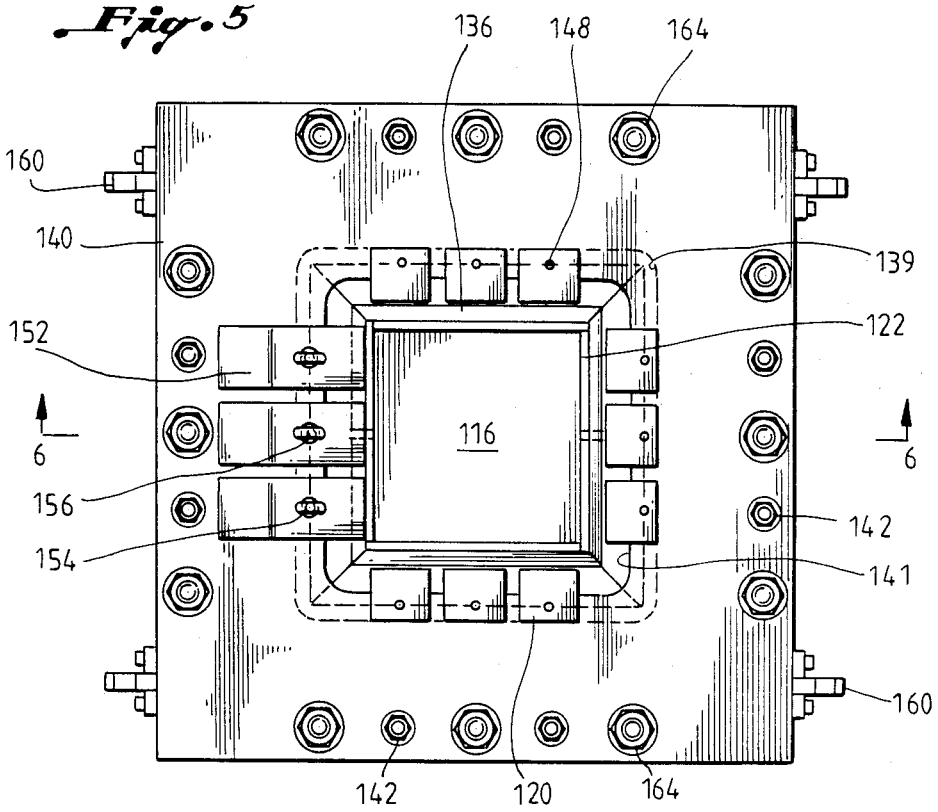
FIG. 5 is a top view of the die embodiment of FIG. 4.
Figure 6:
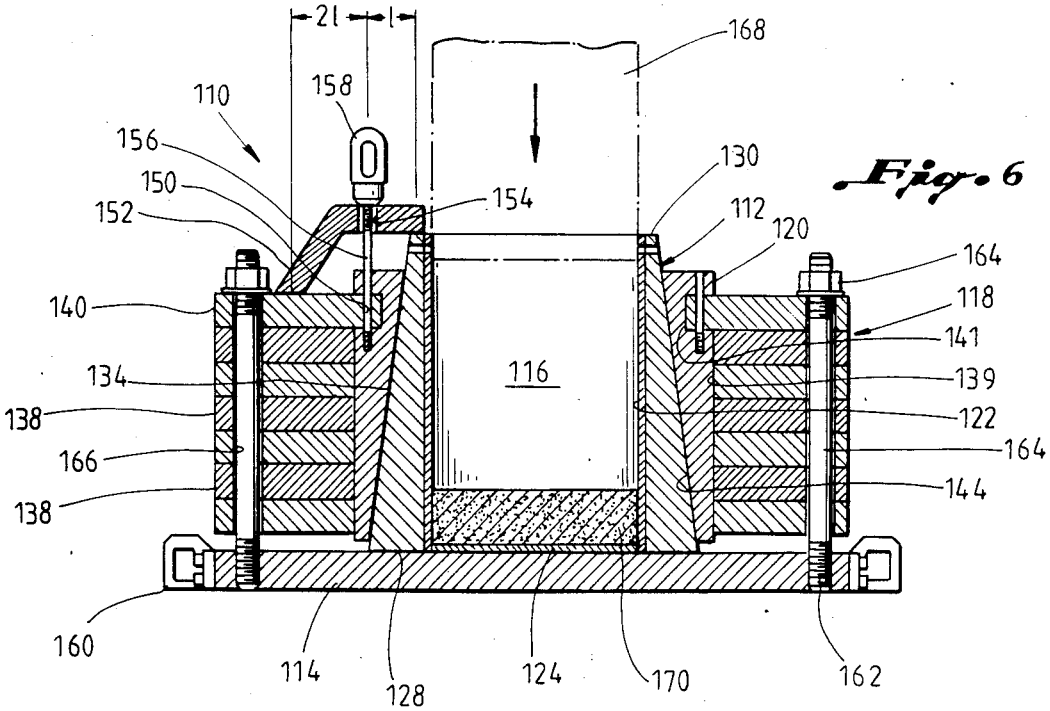
FIG. 6 is a sectional view of the die taken along line 6—6 of FIG. 5.

Another embodiment of a die constructed in accordance with the present invention is shown in FIGS. 4–6. Die 110 is generally made up of four die segments 112 and a base 114 which form a die chamber 116. A retainer 118 surrounds die segments 112, and a plurality of wedges 120 cooperate with the die segments and the retainer, as will be explained more fully below.

Die chamber 116 is lined with side wall liners 122 and a base liner or anvil 124. The liners are made of tool steel to provide a smooth, hard surface for the die chamber. Each side wall liner 122 is attached to its corresponding die segment 112 by a plurality of studs extending through the die segment and into the liner (not shown). This permits the liners to be easily disconnected from the die segments for replacement as the surfaces of the liners wear out over time.

Each die segment 112 has a bottom surface 128 which rests against base 114 and a top surface 130. Opposed angled lateral faces 132 of each die segment each mate with an adjacent lateral face 132 of an adjacent die segment. Each die segment also has an exterior sloped camming surface 134. With the die segments assembled, exterior camming surfaces 134 form a continuous frustropyramidal surface 136.

Retainer 118 is made up of a plurality of stacked lower retainer plates 138 each with a central aperture 139 extending therethrough and a top retainer plate 140 with a relatively smaller central aperture 141. Because top retainer plate 140 has a smaller central aperture, the top retainer has an overhanging inside edge. A plurality of pairs of threaded studs and nuts extend from the upper side of top retainer plate 140 down through apertures (not shown) in retainer plates 138, 140 and are threaded into a threaded aperture in the lowermost retainer plate 138. The stud and nut pairs 142 thereby hold the retainer plates in a rigid, unitary retainer unit.

Each wedge 120 has an inside camming surface 144 having a slope equal to that of the sloped exterior camming surfaces 134 of the die segments. Each wedge also has an outward opening notch 146 adapted to fit over the overhanging edge of top retainer plate 140. A wedge aperture 148 extends from the upper side of each wedge downwardly into the wedge to a point below notch 146. The portion of each aperture 148 below the notch is threaded.

When the wedges are positioned on retainer 118 with notch 146 engaged on top retainer plate 140, each wedge aperture 148 is lined up with a corresponding aperture 150 in top retainer plate 140. An angled puller bar 152 is associated with each wedge 120 (puller bars are shown in FIGS. 5 and 6 along only one side of die 110 for clarity). Each puller bar 152 rests against the upper surface of top retainer plate 140 and top surface 130 of a die segment 112.

When in position as best seen in FIG. 6, an aperture 154 in each puller bar is lined up with apertures 148 and 150 in the associated wedge and in the top retainer plate, respectively. A threaded wedge stud 156 extends downwardly through apertures 148, 150 and 154 with the lower portion of the stud being threaded into the lower portion of wedge aperture 148. A puller eye nut 158 is threaded onto the upper end of each wedge stud 156. The aperture 154, wedge stud 156, and eye nut 158 are located closer to the end of puller bar 152 resting on the top surface 130 of die segment 112 than to the end resting on top retainer plate 140, for reasons of quick releasing the retainer as will be discussed more fully below. Preferably, the ratio of these distances is about 2:1.

Base 114 has four lifting eyes 160 bolted onto its outer edges to aid in handling of the die. Base 114 also has a plurality of vertical threaded apertures 162 around its periphery. A corresponding plurality of stud and nut pairs 164 extend downwardly through apertures 166 in retainer plates 138, 140 and are threaded into threaded apertures 162 in the base.

Assembly of die 110 is best illustrated in FIGS. 4 and 6. Retainer plates 138, 140 are stacked and bolted together by studs and nuts 142. Wedges 120 are positioned on top retainer plate 140 as shown. Base liner 124 is positioned on base 114, and die segments 112 are positioned on the base with their side wall liners 122 positioned against base liner 124. Retainer 118 is then lowered over the die segments into the position shown in FIG 6. Stud and nut pairs 164 are inserted through retainer 118 and threaded into apertures 162 in the base. Wedge studs 156 are inserted through apertures 154 in puller bars 152 with their lower ends threaded into the wedges. Puller eye nuts 158 are brought snugly into contact with puller bars 152.

With all of the component parts in position, the nuts of stud and nut pairs 164 are tightened down against top retainer plate 140. This secures retainer 118 to base 114, and brings camming surfaces 144 of wedges 120 into tight engagement with frustopyramidal surface 136. Retainer 118 thus holds die segments 112 tightly together.

The die is now ready to accept material for compaction. Material is placed in die chamber 116, and a ram 168 under pressure is brought down into contact with the material. As shown in FIG. 6, with ram 166 (shown in phantom) withdrawn, the material has been compressed into a compact 170.

To disengage the retainer and wedge unit from die segments 112, nut and stud pairs 164 are first loosened. Puller eye nuts 158 are then tightened down against puller bars 152. This tends to urge retainer 118 upwardly because eye nuts 158 and studs 156 are positioned closer to wedges 112. This creates a net upward force on retainer 118. At a critical point, the additional tightening of one or two eye nuts will suddenly disengage frustopyramidal surface 136 from the inside camming surfaces 144 of the wedges. This upward movement simultaneously releases the inward lateral forces retaining die segments 112 against compact 170, permitting the compact to be removed from the die without delamination.

The foregoing description has been directed to particular embodiments of the invention in accordance with the requirements of the patent statute for the purpose of illustration and explanation. It will be apparent, however, to those skilled in the art, that many modifications and changes in the apparatus and method set forth will be possible without departing from the scope and spirit of the invention. It is intended that the following claims be interpreted to embrace all such modifications and changes.

What is claimed is:

1. A die for forming compacts from finely divided solid particles or a mixture of fine and coarse solid particles in a dry, semi-dry or plastic state by applying high pressure through a ram to the particles; comprising:

a. a laterally disposed base;

b. a plurality of die segments resting on the base and forming an upwardly open die chamber to receive a ram under pressure, each die segment comprising
   (1) an interior wall defining a portion of the die chamber;
   (2) an exterior camming surface inclined radially inwardly from the base upwardly toward the top of the die segment; and
   (3) first and second lateral faces, each first lateral face of one die segment mating with a second lateral face of an adjacent die segment;

c. a retainer adapted to be lowered around the die segments to peripherally enclosed the mated die segments, the retainer having internal camming surface portions engaging the exterior camming surfaces of the die segments to prevent substantial horizontal and vertical movement of the die segments when pressure is applied to the solid particles placed in the chamber;

d. means for securing the retainer in relation to the base; and e. means for simultaneously applying a force on the die segments toward the base and an opposing force on the retainer away from the base to essentially simultaneouly disengage the internal camming surface portions of the retainer from the exterior camming surfaces of the die segments.

2. The die of claim 1, wherein:

a. the retainer is secured in relation to the base by a plurality of bolts each extending through a separate aperture in the retainer and threading into a corresponding threaded aperture in the base; and b. the moving means comprises:
   (i) a plate bearing against top surfaces of the die segments; and
   (ii) at least one bolt extending through an aperture in the plate and into an aperture in the retainer.

3. The die of claim 1, further comprising an anvil extending upwardly from the base, the anvil having a shape in plan identical to the profile of the die chamber and having outer walls adapted to engage the lower portion of the interior walls of the die segments.

4. The die of claim 1, 2 or 3, or 11 wherein:

a. the exterior camming surfaces of the die segments form a continuous frustoconical surface; and b. the retainer is ring-shaped and the internal camming surface portions of the retainer comprise a continuous frustoconical surface.

5. The die of claim 4 wherein the first and second lateral faces of the die segments each comprises a longitudinally stepped surface.

6. The die of claim 5, wherein an interior corner of the first and second lateral faces is notched to relieve stress concentrations.

7. The die of claim 4, wherein the die chamber profile is rectangular.

8. The die of claim 1, 2, 3 or 11 wherein:

a. the exterior camming surfaces of the die segments form a frustopyramidal surface; and b. the retainer is rectangular-shaped with a plurality of discrete internal camming surfaces projecting inwardly from the retainer at spaced points around the inside perimeter of the retainer.

9. The die of claim 8, wherein the retainer comprises:

a. a plurality of stacked plates bolted together, each plate having a central aperture extending therethrough; and b. a plurality of wedges positioned around the periphery of the central apertures, each wedge providing a discrete internal camming surface.

10. The die of claim 8, wherein the die chamber profile is rectangular.

11. A die comprising:

a. a base;

b. a plurality of die segments positioned against the base and forming a die chamber, each die segment comprising (1) an interior wall defining a portion of the die chamber;

(2) an exterior camming surface inclined radially inwardly from the base toward the end of the die segments remote from the base;

(3) first and second lateral faces, each first lateral face of one die segment mating with a second lateral face of an adjacent die segment;

c. a retainer adapted to be positioned around the die segments to peripherally enclose the mated die segments, the retainer having internal camming surface portions engaging the exterior camming surfaces of the die segments;

d. means for securing the retainer in relation to the base; and e. means for simultaneously applying a force on the die segments toward the base and an opposing force on the retainer away from the base to essentially simultaneously disengage the internal camming surface portions of the retainer from the exterior camming surfaces of the die segments.

* * * * *